US005277259A

United States Patent [19]

Schmid et al.

[11] Patent Number: 5,277,259

[45] Date of Patent: Jan. 11, 1994

[54] HAMMER DRILL WITH HAMMER DRIVE ACTION COUPLING

[75] Inventors: Wolfgang Schmid, Filderstadt; Jörg Faelchle, Bempflingen; Walter Laubengaier, Leinfelden-Echterdingen, all of Fed. Rep. of Germany

[73] Assignee: Robert Bosch GmbH, Stuttgart, Fed. Rep. of Germany

[21] Appl. No.: 773,899

[22] PCT Filed: May 12, 1990

[86] PCT No.: PCT/DE90/00341

§ 371 Date: Oct. 29, 1991

§ 102(e) Date: Oct. 29, 1991

[87] PCT Pub. No.: WO90/14929

PCT Pub. Date: Dec. 13, 1990

[30] Foreign Application Priority Data

May 31, 1989 [DE] Fed. Rep. of Germany ..... 3917644
Sep. 20, 1989 [DE] Fed. Rep. of Germany ..... 3931329

[51] Int. Cl.[5] ..... B25D 11/10

[52] U.S. Cl. ..... 173/13; 173/48; 173/109; 173/205

[58] Field of Search ..... 173/47, 48, 109, 13

[56] References Cited

U.S. PATENT DOCUMENTS

| | | | |
|---|---|---|---|
| 4,280,359 | 7/1981 | Schmid et al. | 173/48 X |
| 4,529,044 | 7/1985 | Klueber et al. | 173/48 |
| 4,537,264 | 8/1985 | Schmid et al. | 173/48 |
| 4,567,950 | 2/1986 | Fushiya et al. | 173/48 |
| 4,657,088 | 4/1987 | Grossmann et al. | 173/109 X |
| 4,719,976 | 1/1988 | Bleicher et al. | 173/109 |

FOREIGN PATENT DOCUMENTS

| | | | |
|---|---|---|---|
| 3506695 | 8/1986 | Fed. Rep. of Germany . | |
| 0024072 | 1/1990 | Japan | 173/48 |

*Primary Examiner*—Frank T. Yost
*Assistant Examiner*—Rinaldi Rada
*Attorney, Agent, or Firm*—Michael J. Striker

[57] ABSTRACT

A power tool has a tool spindle, a hammer unit, a drive including a motor having a motor driven shaft, a motion conversion gear for generating reciprocating piston movement, and a disengageable coupling located between the motor and the motion conversion gear and engaging the hammer unit. The coupling has two coupling parts which held apart, one of the coupling parts being axially fixed and another of the coupling parts being axially movable and arranged on the motor-driven shaft rotatable relative to the shaft. A gear linkage connects the another coupling part with the shaft and transmits portions of a torque of the shaft to the another coupling part in form of an axially directed closing force.

18 Claims, 2 Drawing Sheets

HAMMER DRILL WITH HAMMER DRIVE ACTION COUPLING

BACKGROUND OF THE INVENTION

The invention is related to a hammer drill having a coupling which is engaged for generating movement to a tool spindle in the drill when the tool is against a work surface.

A motorised hammer drill is already known from German Patent Publication DE-OS 35 06 695 (corresponding to U.S. Pat. No. 4,719,976), the hammer unit of which can be switched off by means of a coupling between a motor-driven intermediate shaft and the motion conversion gear, which produces the reciprocating piston movement. The coupling force is amplified by a lever which is loaded by the reaction forces of the hammer unit. The amplifying force applied to the coupling is absorbed by a pin in the housing and a bearing of the intermediate shaft, which is supported in a special metal bearing bridge. The effectiveness of the force amplification can be reduced by tolerances of the lever, the bearing pin and the bearing bridge. With very adverse conditions during operation, the generation of heat can cause yield of the plastic housing and thus a displacement of the pin. Moreover, any undesirable reduction of the pressing force with such lever designs can lead to a lengthening of the engagement path.

SUMMARY OF THE INVENTION

In contrast, the hammer drill according to the invention includes a first coupling portion being mounted axially to the drive shaft of the hammer drill, a second coupling portion being rotatably mounted to the drive shaft and capable of axial movement along the drive shaft and means for transmitting torque of the drive shaft, the transmitting means coupling the second coupling portion to the drive shaft such that torque of the drive shaft can be transmitted as an axially directed force to the second coupling portion to close the coupling has the advantage that both the pressing force and the pressing path for switch-on of the hammer unit are reduced. This is achieved by an automatically amplifying coupling which utilizes the hammer's motor power to increase the coupling force, or in other words, the axial force for closing the coupling.

Additional and advantageous developments and improvements of the hammer include, for example, gear connections with control faces or contours which extend obliquely in an axial direction to enable a conversion of the rotational movement of the motor-driven shaft to an axial displacement of a control sleeve, so long as this has a different rotation-al speed from that of the shaft. Another feature of the invention facilitates positive engagement of the coupling when the hammer action is actually required.

The design of the hammer has the advantage that the effectiveness of the coupling force amplification is independent of the reactions of non-associated components, such as housings, etc. This is achieved by virtue of the fact that, outwardly, the intermediate shaft is free from coupling forces. This obviates any tolerances originating outside, i.e. from housing parts, levers, and the like, which would impair the function. The plastic housing does not absorb any forces from the amplification of the coupling force. Still another feature of the invention is a brake facility for speedier decoupling.

The present invention both as to its construction so to its mode of operation, together with additional objects and advantages thereof, will be best understood from the following description of preferred embodiments when read with reference to the accompanying drawings.

DETAILED DESCRIPTION OF THE PREFERRED EMBODIMENTS

Figure 1:
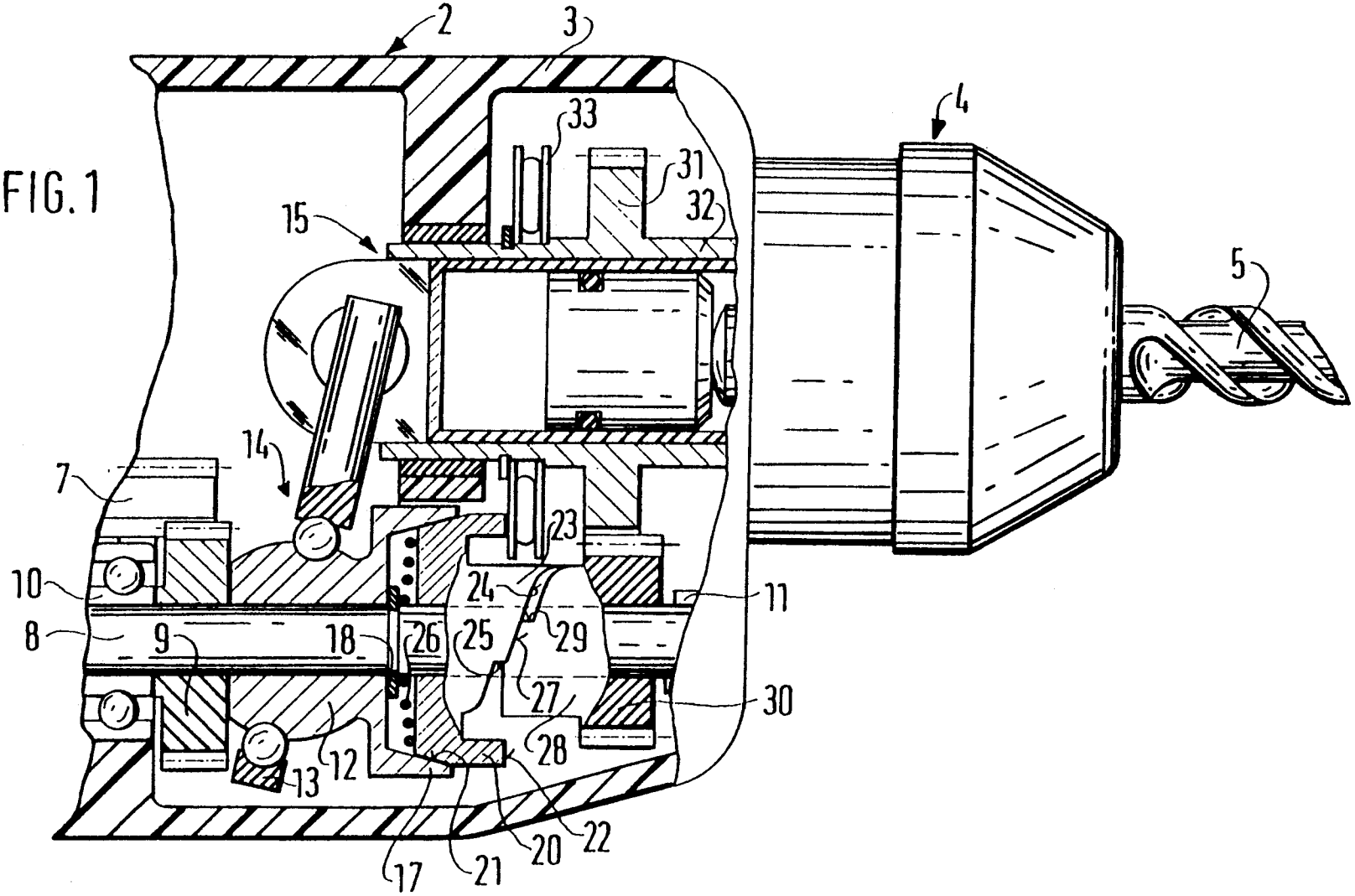
FIG. 1 shows a longitudinal cross-section of a front portion of a hammer drill constructed in accordance with a first embodiment of the present invention.

The hammer drill 2 is surrounded by a plastic housing 3 and has a tool holder 4 at the front into which a tool 5 can be inserted. Located within the housing is a motor, not shown here, of which only the motor pinion 7 is visible. The pinion 7 meshes with a toothed wheel 9 which is fixedly connected with a shaft 8. The shaft 8, also described as an intermediate shaft, rests with both ends in bearings 10,11 in the housing 3. Next to the toothed wheel 9, is a coupling part 12 which is freely rotatable but axially fixed on the intermediate shaft, on which a wobble plate is arranged as drive member 13 of a motion conversion transmission 14. The design of the wobble plate gear 14 and the hammer unit 15 driven by it, is fully described in the German Patent Publication DE-OS 35 06 695.

On the side facing away from the toothed wheel 9, the coupling part 12 has an inner taper 17 which has an acute angle relative to the shaft axis. The coupling part 12 is axially fixed on the intermediate shaft 8 by a retainer ring 18. The coupling part 12 can be coupled with a coupling part 20, which is rotatable on the shaft 8 and axially displaceable, with the outside taper of cone 21. The cone 21 has a taper area which corresponds to the inner taper of cone 17 and can be engaged with it in a positive drive. The coupling part 20 has a radial annular stop face 22 which faces away from the fixed coupling part 12 and which provides for the engagement of an actuating member for the coupling.

The coupling part 20 also has a drum-shaped control sleeve 23 which surrounds the shaft 8 and which has on its front, facing away from the cone area 21, a control face 24 which is essentially helicoid. The pitch of the control face 24 is not self-locking. The control face has a projection with a short, axially directed section 25. Engaging on the coupling part 20 is a separating spring 26 which is supported against the retaining ring 18 and which acts to effect a separation of the coupling.

Located against the control face 24 is a corresponding control face 27 of a control disc 28, which is fixedly connected, or forms one part with the shaft 8. The control face 27 also has a projection with a short, axially directed section 29. The control disc 28 is connected in one piece with a spur gear 30 which engages with a toothed wheel 31 on the tool spindle 32 of the motor hammer, and drives it to rotate continuously. Adjacent to the toothed wheel 31 on the main spindle, an axial bearing 33, equipped with rolling bodies is arranged, which can be pressed against the stop face 22 of the coupling part 20. The main spindle 32 is connected with the tool 5 via the tool holder 4 and is axially slidable within limits. The hammer unit 15 is accommodated within the main spindle.

At the start of a drilling process, the motor is switched on and drives the tool spindle via the toothed wheels 7, 9, 30, and 31. The coupling part 20 is forced against the control disc 28 by the spring 26, so that the control faces 24 and 27 rest against each other, without a gap, and the sections 25 and 29 lie opposite each other. In this position, the coupling part 20 is carried by the control disc 28 in rotation and does not shift axially vis-a-vis the control disc 28.

As soon as the tool 5 is pressed against the work area, the work spindle 32 is displaced inwards, to the extent of its axial play. The axial bearing 33 forces the slidable coupling part 20 against the fixed coupling part 12. At the same time, a gap develops between the control faces 24 and 27. As soon as this gap becomes wider than the length of the axial sections 25 and 29, respectively, and the cone faces 17 and 21 make contact with each other, the coupling part 20 is braked by the fixed coupling part 12, and the drive connection 23, 24, 27, 28 becomes effective for the engagement of the coupling and the amplification of the coupling force. In this action, the parts 20 and 28 rotate against each other, so that the parts of the control faces 24 and 27, which project axially beyond sections 25 and 29, now contact each other, as shown in FIG. 1. Locked by force, the coupling part 20 is caused to rotate by control disc 28 via the control faces 24 and 27, simultaneously being axially pressed against the coupling part 12 against the force of the spring 26. The coupling part 20 is thereby wedged between the fixed coupling part 12 and the control disc 28, thus resulting in an automatic amplification of the coupling force. With the coupling 12,20 closed, the rotating movement of the intermediate shaft 8 is transmitted, via the spur gear 30 and the coupling part 20, to the coupling part 12 which is part of the wobble drive 14, and the hammer unit 15 is started.

When the tool lifts away from the work area, the pressing force of the axial bearing 33 onto the coupling part 12 disappears. If the hammer unit 15 happens to be in the pressure phase, that is, not being actively driven by the intermediate shaft 8, but during the return stroke, itself briefly driving the intermediate shaft, the automatic amplification effect of control faces 24 and 27 will also briefly disappear. At this moment, the force of the spring 26 is sufficient to drive apart the coupling parts 12 and 20 and thereby disengage the coupling, which results in the desired stoppage of the hammer unit 15.

Figure 2:
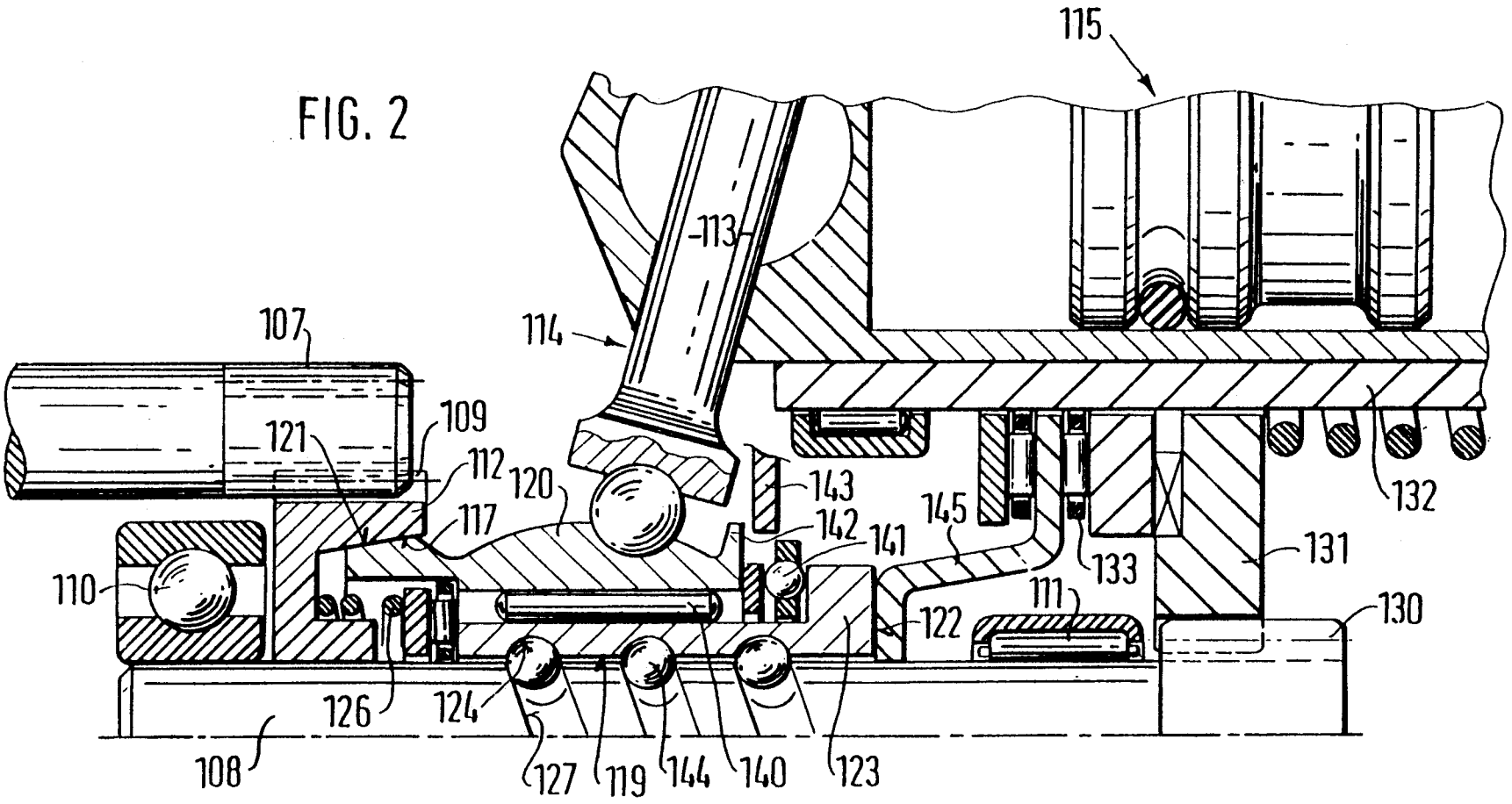
FIG. 2 shows a longitudinal cross-section of a hammer unit of the hammer drill constructed in accordance with a second embodiment of the present invention.

In the embodiment of FIG. 2, elements which correspond to those of the first embodiment, are given reference numbers which are increased by 100. The rotation of the motor pinion 107 is transmitted to the shaft 108 via a toothed wheel 109 which is firmly connected with the shaft, for example by welding. The shaft 108 is mounted in two bearings 110 and 111, parallel with the axis of the motor pinion 107. At the same time, the toothed wheel 109 forms an axially fixed coupling part 112 with an inner cone 117 which serves as a coupling face. An outer cone 121 acts in conjunction with the inner cone 117 on an axially movable coupling part 120. On the coupling part 120, a driving element 113 of the motion conversion transmission 114 is arranged which drives the hammer unit 115. The coupling part 120 pivots in a needle bearing 140 and an axial bearing 141 on a control sleeve 123. The coupling part 120 carries a nose 142, which, in the decoupled condition of the coupling, can act in conjunction with an axially fixed brake-plate 143.

The control sleeve 123 has in its inner hole 119 a control contour 124 in the form of a helical groove. A corresponding groove is arranged as a control contour 127 in the shaft 108. The grooves 124, 127 contain balls 144, so that a ball screw thread is formed. The front face 122 of the control sleeve 123 has a contact bow 145 resting against it, which is connected via an axial bearing 133, with an axially movable tool spindle 132. Attached to the tool spindle 132 is a toothed wheel 131, which meshes with a spur gear 130 on the shaft 108.

The function of the coupling 112/120 in the second embodiment corresponds to that of the first embodiment. As soon as the tool spindle 132 is pushed inward to the extent of its axial play, under contact pressure from the tool against a work area, the pressing lever 145 presses against the control sleeve 123 and displaces it in the direction of the coupling part 112. As the drive connection 123, 124, 127, 144 becomes effective, or in other words the coupling attains its coupled condition, the coupling part 112 attains a position such as shown in FIG. 2. In this action, the control sleeve 123 is braked relative to the shaft 108 and, because of the different rotating speed due to the ball screw thread 124, 127, 144, is moved in the direction of the fixed coupling part 112.

With the tool lifted off the rock, the pressing lever 145 is also lifted off the front face 122, and the separating spring 126 together with the gas forces of the hammer unit 115, which exert tension forces on the drive element in phases, cause the disengagement of the coupling 112/120. When the coupling is disengaged, only the control sleeve 123 still rotates with the shaft 108; the coupling part 120 rotates over the bearings 140, 141, relative to the control sleeve 123 and rests opposite the hammer unit 115. Switch-off of the hammer unit is made easier by the brake plate 143, on which the coupling part 120 is braked by brushing against it with its nose 142.

The invention is not limited to the embodiments shown. The individual features of the embodiments can be combined with each other or with features from the cited technology in a different manner, such as the arrangement of a needle bearing on the intermediate shaft for the support of the coupling part 12.

Instead of the purely force-locking design, the coupling 12/20 and 112/120, respectively, can be designed with claws which are more or less flat, in axial direction.

The separating spring 26 can also be integral with into one of the coupling parts 12, 20, such as making this of spring steel or fitting it with spring steel inserts.

The invention is also suitable for straightforward hammer-action tools. This merely requires the removal of toothed wheels 30 and 31, and 130 and 131, respectively.

While the invention has been illustrated and described as embodied in a hammer drill with a hammer drive action coupling, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A power tool, comprising a working part with a tool spindle and a reciprocable hammer unit; a drive for driving said working part and including a motor having a motor-driven shaft, a motion conversion transmission for generating a reciprocating piston movement, and a disengageable coupling located between said motor and said motion conversion transmission and engaging said hammer unit, said coupling including two coupling parts which are held apart, one of said coupling parts being axially fixed and another of said coupling parts being axially movable and arranged on said motor-driven shaft rotatable relative to said shaft so that said another coupling part can be moved toward said one coupling part so as to be coupled with the latter; and a gear linkage means connecting said another coupling part with said shaft and transmitting portions of a torque of said shaft to said another coupling part so as to move said another coupling part toward said one coupling part to be coupled with the latter.

2. A power tool as defined in claim 1, wherein said gear linkage further comprising a first control face extending obliquely in an axial direction and firmly connected with said shaft, and a control sleeve provided with a corresponding second control face which also extends obliquely and is connected with said another coupling part, said control faces cooperating with one another.

3. A power tool as defined in claim 2, wherein said gear linkage further comprising control contours, said coupling being engageable by a helical displacement of said control sleeve along said control contours.

4. A power tool as defined in claim 3, wherein said tool spindle is axially displaceable, said control sleeve being movable by said axially displaceable tool spindle in a closing direction.

5. A power tool as defined in claim 3, wherein said control contours are formed as spiral grooves provided on said shaft and said control sleeve; and further comprising balls retained in said spiral groves.

6. A power tool as defined in claim 2; and further comprising a friction reducing axial bearing arranged between said tool spindle and said control sleeve.

7. A power tool as defined in claim 2, wherein said one coupling part is rotatable relative to said shaft, said gear linkage comprising a control disc provided with said first control face.

8. A power tool as defined in claim 7; and further comprising a spur gear, said control disc being connected with said spur gear for rotatably driving said tool spindle.

9. A power tool as defined in claim 2, wherein said another coupling part is rotatable relative to said control disc so that said another coupling part comes into an effective position both with said one coupling part and with said control disc for transmission of torque.

10. A power tool as defined in claim 2; and further comprising a separating spring which holds said coupling parts of said coupling apart, said another coupling part being pressed against said first control face by said separating spring.

11. A power tool as defined in claim 2, wherein said control faces are provided with projections with axially extending sections for rotational engagement, said projections being opposite to one another when said coupling is disengaged.

12. A power tool as defined in claim 2, wherein said one coupling part is also radially fixedly connected with said shaft, said another coupling part being rotatable relative to said control sleeve.

13. A power tool as defined in claim 1, wherein said motion conversion transmission has a drive element, said one coupling part being arranged on said drive element of said motion conversion transmission.

14. A power tool as defined in claim 1; and further comprising a spring which is arranged between said coupling parts and holds said coupling parts apart.

15. A power tool as defined in claim 1, wherein at least one of said coupling parts is resilient to develop an opening force when said coupling is closed.

16. A power tool as defined in claim 1, wherein at least one of said coupling parts has resilient areas which develop an opening force when said coupling is closed.

17. A power tool as defined in claim 1; and further comprising a braking device for contracting said another coupling part in a decoupled axial position and braking said another coupling part.

18. A power tool as defined in claim 17, wherein said braking device has a fixed brake plate against which said another coupling part contacts in said decoupled axial position so as to braked.

* * * * *